US007536253B2

(12) United States Patent
Ohba et al.

(10) Patent No.: US 7,536,253 B2
(45) Date of Patent: May 19, 2009

(54) TRAFFIC MONITORING APPARATUS

(75) Inventors: Hiroyuki Ohba, Otsu (JP); Shinichi Oku, Otsu (JP); Yasutaka Kawahata, Otsu (JP)

(73) Assignee: Optex Co., Ltd., Shiga (JP)

( * ) Notice: Subject to any disclaimer, the term of this patent is extended or adjusted under 35 U.S.C. 154(b) by 431 days.

(21) Appl. No.: 11/321,529

(22) Filed: Dec. 30, 2005

(65) Prior Publication Data

US 2006/0187120 A1 Aug. 24, 2006

(30) Foreign Application Priority Data

Jan. 31, 2005 (JP) ..... 2005-022493

(51) Int. Cl.
*G08B 13/194* (2006.01)
*G07C 9/00* (2006.01)

(52) U.S. Cl. ..... 701/117; 348/135; 382/154

(58) Field of Classification Search ..... None
See application file for complete search history.

(56) References Cited

U.S. PATENT DOCUMENTS

| | | | | |
|---|---|---|---|---|
| 5,187,688 | A * | 2/1993 | Saruta | 367/96 |
| 5,201,906 | A | 4/1993 | Schwarz et al. | |
| 5,255,301 | A * | 10/1993 | Nakamura et al. | 377/6 |
| 5,305,390 | A * | 4/1994 | Frey et al. | 382/115 |
| 5,581,625 | A | 12/1996 | Connell | |
| 5,926,518 | A * | 7/1999 | Asokawa | 377/6 |
| 6,697,104 | B1 * | 2/2004 | Yakobi et al. | 348/143 |
| 6,963,658 | B2 * | 11/2005 | Hagihara et al. | 382/107 |
| 6,987,885 | B2 * | 1/2006 | Gonzalez-Banos et al. | 382/192 |
| 2004/0017929 | A1 | 1/2004 | Bramblet et al. | |
| 2005/0093697 | A1 * | 5/2005 | Nichani et al. | 340/545.1 |
| 2006/0171570 | A1 * | 8/2006 | Brendley et al. | 382/115 |

FOREIGN PATENT DOCUMENTS

| | | | |
|---|---|---|---|
| EP | 0 706 062 | A1 | 4/1996 |
| EP | 0 716 402 | A1 | 6/1996 |
| EP | 1 074 958 | A1 | 2/2001 |
| JP | 05054142 | A | 3/1993 |
| JP | 07-244714 | A | 9/1995 |
| JP | 08-249444 | A | 9/1996 |
| JP | 09-027021 | A | 1/1997 |
| JP | 09-093472 | A | 4/1997 |
| JP | 10-080560 | A | 3/1998 |

(Continued)

OTHER PUBLICATIONS

R. Mukundan and R.K. Ramakrishnan, "Moment 6-8 functions in image analysis—Theory and Applications", 1998, pp. 1-3, 9-15, and 81-87, World Scientific Publishing Co. PTE. Ltd.

*Primary Examiner*—Michael J. Zanelli
(74) *Attorney, Agent, or Firm*—Sughrue Mion, PLLC

(57) ABSTRACT

To provide a traffic monitoring apparatus capable of accurately determining the number of objects present in an area under surveillance without being affected by the difference in arrangement of those objects. Included is an object information acquiring device 1A for acquiring three-dimensional object information D related with an object H present in an area 8 under surveillance, and a determining device 2A for determining the number of objects based on at least a volume, which is one of a volume and a height of an object obtained from the object information D.

8 Claims, 11 Drawing Sheets

FOREIGN PATENT DOCUMENTS

| | | | | |
|---|---|---|---|---|
| JP | 2001-034883 | A | | 2/2001 |
| JP | 2002-175513 | A | | 6/2002 |
| JP | 2005-309591 | A | * | 11/2005 |
| WO | 96/38820 | A1 | | 12/1996 |
| WO | 03/088157 | A1 | | 10/2003 |
| WO | 2004/111799 | A2 | | 12/2004 |

* cited by examiner

Fig. 11

| Order of Moment | Person of a Big Build | Two Persons in Line (Average Height and Weight) | Two Persons in Side-by-Side(Average Height and Weight) |
|---|---|---|---|
| 1 | 4. 12565 | 5. 45531 | 6. 21642 |
| 2 | 19. 6301 | 32. 1444 | 47. 8943 |
| 3 | 101. 164 | 199. 753 | 413. 29 |
| 4 | 548. 748 | 1289. 65 | 3828. 63 |
| 5 | 3085. 52 | 8570. 29 | 37245. 7 |
| 6 | 17820. 8 | 58271. 5 | 375352 |
| Sum of Block Heights (Volume) | 201986 | 170400 | 170400 |

TRAFFIC MONITORING APPARATUS

BACKGROUND OF THE INVENTION

1. Field of the Invention

The present invention relates to a traffic monitoring apparatus for monitoring the number of objects such as people moving past an area under surveillance such as, for example, entrance and exit portals of a revolving door.

2. Description of the Prior Art

In recent years, as a security technology to curb the flow of information from corporations, the control system is known, in which a verifying device is installed in each of the important entrance and exit of a commercial building so that only when a person is attested as an authorized person through the ID card or the fingerprint, the door at the entrance or exit can be opened.

With the foregoing security technology, it is necessary to block passage of one or more persons trying to pass through the entrance or exit while tailgating, or following side by side with, the authorized person, who has been given a permission to pass through the entrance or exit after having inserted his or her regular ID card into an ID card verifying device. Accordingly, attempts have hitherto been made to lay a body weight sensitive floor mat on an area under surveillance in the vicinity of the door so that when the body weight detected by the body weight sensor built in the floor mat is greater than a threshold value, determination can be made that a plurality of persons exist and the opening of the door is hence inhibited and, alternatively, to use a monitoring system in which a plurality of ultrasonic sensors are secured to the ceiling above the door, with those ultrasonic sensors storing on a time-series basis information on the body height of an object measured thereby, so that when the average body height of a person appears continuously in the body height information, determination is made that there are two persons and the opening of the door is hence inhibited. See, for example, U.S. Pat. No. 5,201,906.

On the other hand, as another monitoring device, it is known to use a method in which a contour pattern in image data imaged with a tracking camera installed at the area under surveillance in the vicinity of the door is compared and collated with a reference pattern stored beforehand to determine the number of persons existing. See, for example, Published United States Patent Application No. 2004/0017929.

It has, however, been that with the monitoring device in which the body weight sensitive floor mat is laid, and considering that it may occur that the body weight of a single person of a big build would exceed the sum of respective body weights of two persons of a small build, setting of the threshold value to a low value will result in that an authorized person of a big build will not be allowed to pass, but setting of the threshold value to a high value will result in that two persons of a small build will be allowed to pass. Also, with the monitoring device in which the ultrasonic sensors are installed, when two persons in proximity to each other try to pass, information will become comparable to the body height information on a single person on a time-series basis, resulting in an erroneous determination that it is a single person. On the other hand, with the monitoring device based on the image data photo-taken by the tracking camera, the pattern matching cannot be taken, resulting in an erroneous determination in the event that a plurality of persons try to pass in a posture not found in the preset reference pattern, for example, in the event that one person in a standing posture and another person in a bowing posture try to pass.

SUMMARY OF THE INVENTION

The present invention has been devised in view of the foregoing problems and inconveniences inherent in the prior art and is intended to provide a traffic monitoring apparatus capable of accurately determining the number of objects such as, for example, persons present in an area under surveillance without being affected by the difference in arrangement of those objects.

In order to accomplish the foregoing object of the present invention, the traffic monitoring apparatus according to a first aspect of the present invention includes an object information acquiring device for acquiring three-dimensional object information related with an object present in an area under surveillance, and a determining device for determining the number of objects based on at least a volume, which is one of a volume and a body height of an object obtained from the object information.

According to this construction, since the number of the objects is determined based on at least the volume of the three-dimensional object information, and let it be assumed that an object stands for a person, the object information will be the one having a large volume corresponding to the sum of respective volumes of two persons in the case where there are two persons, and since the volume of the sum of those of the two persons will be larger than a preset threshold value, it is possible to assuredly determine that they are a plurality of persons, even when two persons of a small build try to pass in proximity to each other. On the other hand, where what exists is a single person, in most cases there is no possibility that an erroneous determination that they are a plurality of persons may occur, since there is little persons having a build enough to exceed the volume of the sum of the respective volumes of the two persons.

In the structure according to the first aspect of the present invention, the determining device may be the one capable of determining the number of the objects based on the threshold value of the volume. According to this construction, if the volume of the threshold value is set to a value greater than the average volume of, for example, a tall person and smaller than the sum of the respective average volumes of two persons of short stature, distinction between whether the number of persons is singular and whether the number of persons is plural can be substantially accurately accomplished based on the magnitude of the threshold value of the volume.

Also, in the structure according to the first aspect of the present invention, the determining device referred to above is preferably operable to determine the number of the objects based on the threshold value of the volume which varies depending on the body height. According to this feature, in the case where, for example, one or two persons are to be determined, if the volume of the threshold value is so chosen as to be a value that varies from the minimum value, which is larger than the maximum possible volume of one person of short stature and smaller than the sum of minimum possible volumes of two persons of short stature, and to the maximum value, which has successively increased to a higher value with increase of the body height and which is larger than the maximum possible volume of one person of tall stature and smaller than the sum of minimum possible volumes of two persons of tall stature, a possible erroneous determination that a single person of an extremely big build may be determined as a plurality of persons and a possible erroneous determination that two persons of an extremely small build trying to pass in proximity to each other may be determined as a single person can be eliminated, with the accuracy of determination of the number of the objects increased consequently. Determination of three or more persons can be accomplished by setting the threshold value for each of quantitative values.

Also, in the structure according to the first aspect of the present invention, the object information acquiring device may be of a structure including a corrected volume calculating unit for determining the volume of the object except for a portion having a body height exceeding a predetermined value. According to this feature, for example, by determining the volume of a person except for an upper portion exceeding a relatively low value of 160 cm, a distinction between the volume of a single person of a big build and the volume of two persons of short stature makes clearer as far as a person of a body height exceeding 160 cm is concerned and, therefore, even the use of a predetermined value regardless of the body height for the threshold value can bring about increase of the accuracy of determination of the number of the objects.

The traffic monitoring apparatus according to a second aspect of the present invention includes an object information acquiring device for acquiring three-dimensional object information related with an object present in an area under surveillance, and a determining device for determining the number of objects based on a distribution, in a two-dimensional plane, of volumes of objects from the object information. According to this construction, since the distribution of the volumes of the object information acquired shows up in an arrangement of a clot in the case where the number of the objects is singular or in an arrangement of separate clots in the case where the number of the objects is plural, the number of the objects can be determined almost without being affected by influences brought about by the difference in body height and volume of the individual objects and, in particular, even where two persons in close proximity to each other try to pass, it is possible to accurately determine that there are two persons.

The determining device in the construction according to the second aspect of the present invention may preferably include a moment calculating unit for determining the moment of the distribution based on the distance in the two-dimensional plane of the distribution from the reference point to the point of distribution and for calculating the value of the moment which is normalized by the volume of the object, and a determining device for determining the number of the objects based on the moment value. According to this feature, since the value of the moment varies depending on the number of the object, an intermediate value of the various moment values can be set as a threshold value, allowing the number of the objects to be accurately determined. Also, since the value of the moment is normalized by the volume, the value of the moment which is not affected by the difference in volume of the persons can be obtained.

The reference point referred to above in the construction according to the second aspect may be a position of the center of gravity of the distribution in the two-dimensional plane. According to this feature, where the number of the objects present is singular, the center of gravity of the distribution lies in the vicinity of the center of the object in the two-dimensional plane, but where the number of the objects present is plural, the center of gravity of the distribution lies at a position between the entire objects in the two-dimensional plane. Accordingly, using this position as the reference point, the difference in value of the moment resulting from the number of the objects can be increased and, therefore, the number of the objects can easily be determined.

The reference point in the construction according to the second aspect may be a vertex at which the body height attains a maximum value. According to this feature, the reference value can easily be determined from the object information. Also, if the object is a person, and where the number of persons present is singular, the top of the head will become the reference point, but where the number of persons is two, the top of the head of the taller person will become the reference point. Accordingly, the difference in value of the moment resulting from the number of the objects can be increased, thereby facilitating the determination of the number of the objects.

The traffic monitoring apparatus according to a third aspect of the present invention includes an object information acquiring device for acquiring three-dimensional object information related with an object present in an area under surveillance, a first information generating device for generating a first quantitative information related with the number of objects based on at least the volume, which is one of a volume and a body height of an object obtained from the object information, a second information generating device for generating a second quantitative information related with the number of objects based on a distribution of the volumes of objects in a two-dimensional plane from the object information referred to above, and a determining device for determining the number of the objects based on the first and/or second quantitative information.

According to this construction, the number of the objects can be determined with high precision from the object information if the first quantitative information based on at least the volume, which is one of the body height and the volume of the object, is combined with the second quantitative information based on the distribution of volumes of the objects.

In the construction according to the third aspect of the present invention, the use may further be made of a weighting unit for weighting at least one of the first and second quantitative information. According to this feature, by properly setting the magnitude of the weighting in dependence on the environment of the area under surveillance, the accuracy of quantitative determination can be increased.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

FIG. 11 is a chart showing the order of the moment and the moment values calculated by the traffic monitoring apparatus shown in FIG. 9;

DETAILED DESCRIPTION OF THE EMBODIMENTS

Figure 1:
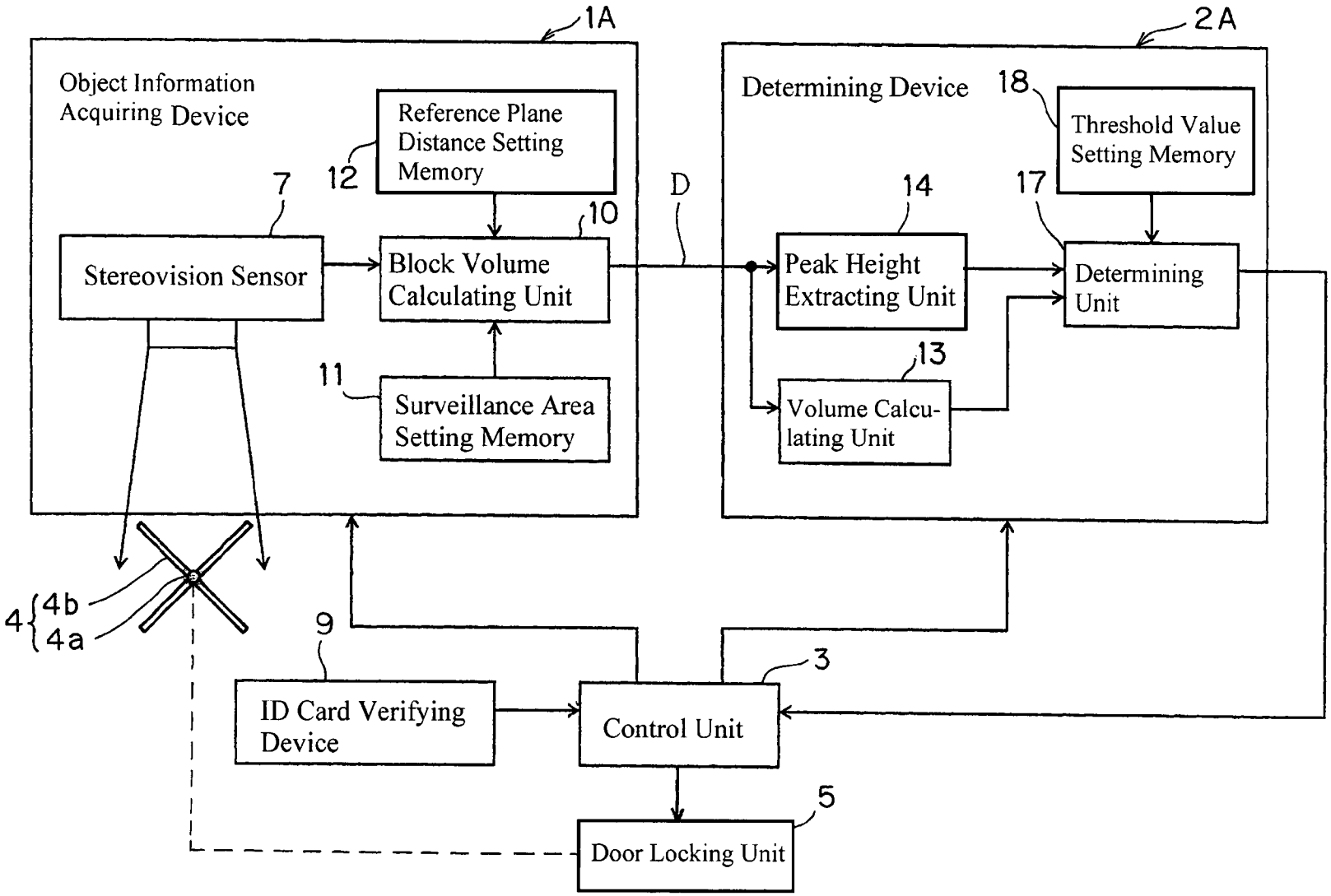
FIG. 1 is a circuit block diagram showing a traffic monitoring apparatus according to a first preferred embodiment of the present invention.
Figure 2:
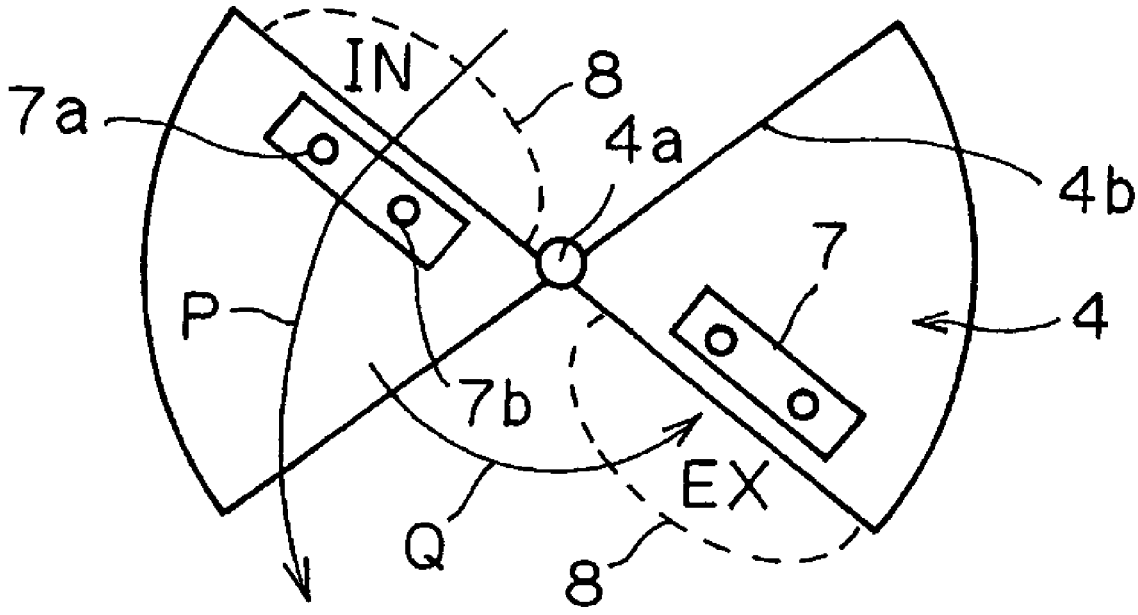
FIG. 2 is a plan view showing an area under surveillance monitored by the traffic monitoring apparatus.

FIG. 1 illustrates a circuit block diagram showing a traffic monitoring apparatus according to a first preferred embodiment of the present invention. This traffic monitoring apparatus includes an object information acquiring device 1A for acquiring three-dimensional object information related with an object present in an area under surveillance, a determining device 2A for determining the number of objects from the object information, based on the body height and the volume of the object, a control unit 3 for controlling the operation of a revolving door 4 based on a result of determination made by the determining device 2A, and a door locking unit 5 controlled by the control unit 3 to lock the operation of the revolving door 4. Accordingly, in this embodiment, there is shown an example in which the present invention is applied to the monitoring of the number of objects such as, for example, persons moving in a direction shown by the arrow P by revolving the revolving door 4 shown in FIG. 2.

The revolving door 4 is of a type including a plurality of wings 4*b* secured to a shaft 4*a* supported at its opposite ends by the floor and the ceiling of a building. In this revolving door 4, a left portion of the figure represents an entrance IN whereas a right portion of the same figure represents an exit EX. A known stereovision sensor 7 is mounted on the ceiling, forming an upper surface of the passageway through the revolving door 4, so as to be proximate to the entrance IN and the exit EX and an area 8 under surveillance shown by the broken line is defined by the stereovision sensor 7. In the description that follows, only the structure provided on a side of the entrance IN will be described for the sake of brevity.

The entrance of the revolving door 4 is provided with an ID card verifying device 9 shown in FIG. 1 and this ID card verifying device is operable to verify whether or not an ID card inserted is a normal one which has been authorized and outputs a verification signal indicative of the result of verification to the control unit 3. At the timing at which the verification signal from the ID card verifying device 9 verifying that the ID card is the normal one is inputted, the control unit 3 performs a control to cause the object information acquiring device 1A and the determining device 2A to operate.

The object information acquiring device 1A shown in FIG. 1 operates based on a command from the control unit 3 to acquire three-dimensional object information related with the object in the following manner. That is to say, the stereovision sensor 7 is operable to determine congruent points from two images, photo-taken by respective cameras 7*a* and 7*b* (FIG. 2), with the use of any known correlation function and then to calculate the distance to the object based on the spacing (azimuth difference) in the coordinate system thereof so that the scene expressed in the form of brightness information can be converted into distance information to thereby secure the distance information as pixel values corresponding to the distance from the stereovision sensor 7.

For the object information acquiring device 1A, in place of the stereovision sensor 7, devices for acquiring three-dimensional object information with a single photosensor can be employed (See U.S. Pat. Nos. 6,323,942 and No. 6,512,838). The area under surveillance appropriate to the angle of revolution of the wings 4*b* of the revolving door 4 is properly divided into a plurality of blocks on a two-dimensional plane (the floor surface in the illustrated instance), with the coordinate system of each of those blocks stored in a surveillance area setting memory 11. A reference plane distance setting memory 12 stores, as a reference distance, the distance from the stereovision sensor 7 to a reference plane (Since in this instance it means a floor surface, reference will hereinafter be made to the floor surface.).

A block volume calculating unit 10 of the object information acquiring device 1A is operable to extract only distance information, corresponding to the block stored in the surveillance area setting memory 11, from the stereovision sensor 7, to convert the extracted distance information for each of the blocks into the distance information from the reference distance, stored in the reference plane distance setting memory 12, to thereby determine the body height from the reference plane in each of those blocks, and to secure the three-dimensional object information which is the volume of the object for each of those blocks.

Figure 3A:
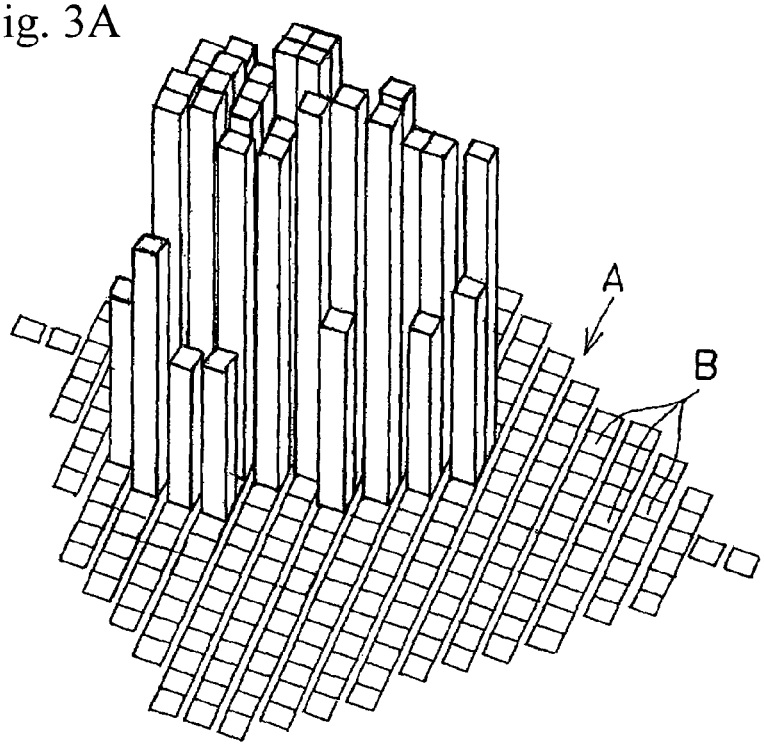
FIG. 3 is a schematic diagram showing three-dimensional object information acquired by the traffic monitoring apparatus, wherein (a) and (b) show respective cases in which the number of objects is singular and plural.
Figure 3B:
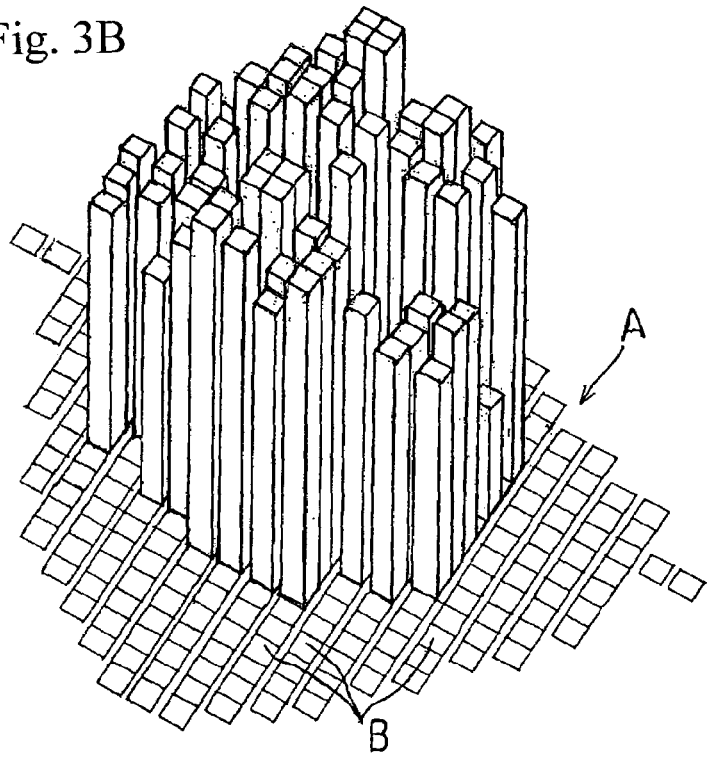

FIG. 3 illustrates schematically the three-dimensional object information acquired by the block volume calculating unit 10, wherein (a) represents the case with a single person and (b) represents the case with two persons and the body height and the volume of the object present within the effective area A under surveillance are shown for each of the blocks B.

Figure 4A:
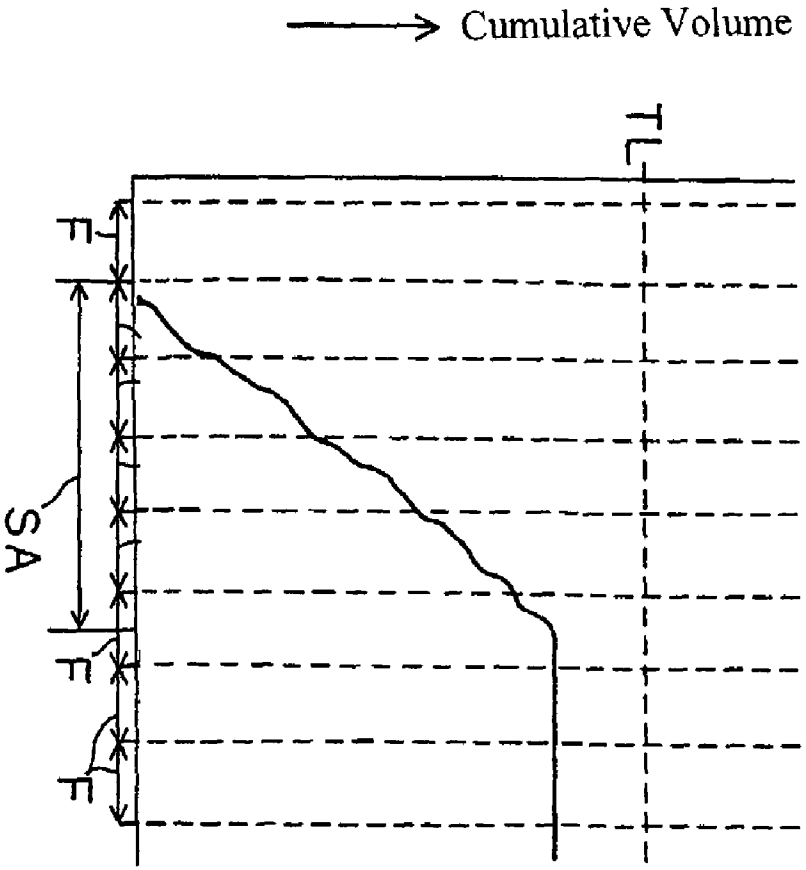
FIG. 4 is a characteristic chart showing volume information acquired by the traffic monitoring apparatus, wherein (a) and (b) show respective cases in which the number of objects is singular and plural.
Figure 4B:
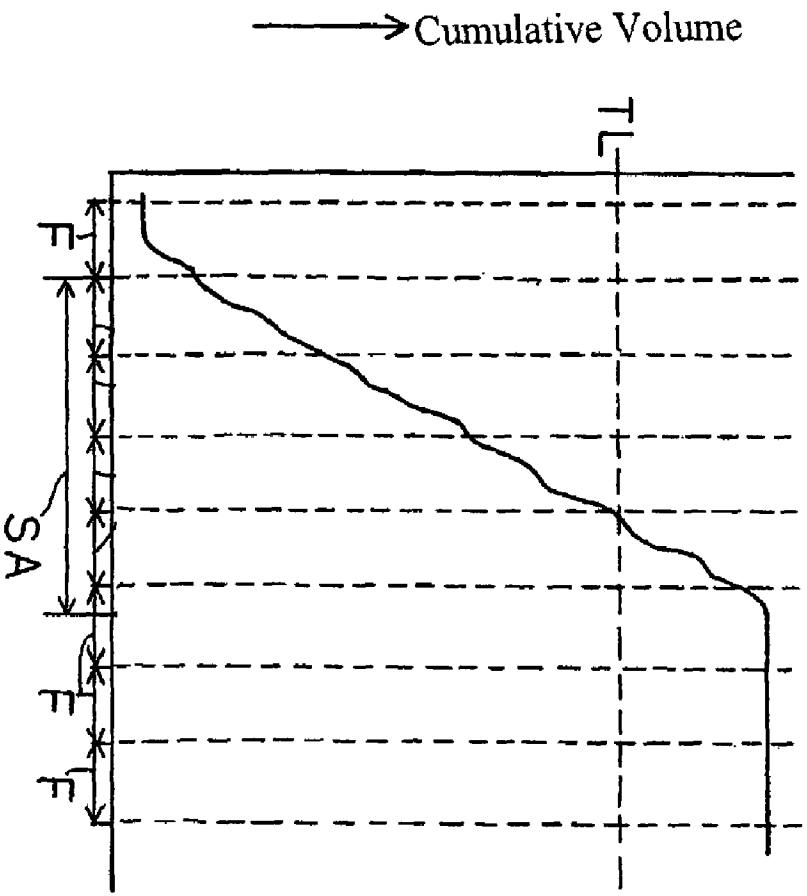

The three-dimensional object information D outputted from the object information acquiring device 1A shown in FIG. 1 is inputted to the determining device 2A. A volume calculating unit 13 of the determining device 2 is operable to calculate volume information, which is a cumulative volume for each of frames of images, by adding, for each frame, body height information of each of the blocks B that is shown in the respective frame. Since a person can move, the volume of the person is obtained by determining the cumulative volume relative to the length of time passed. FIG. 4 illustrates the volume information, which is the cumulative volume for each frame F, calculated by the volume calculating unit 13, in which SA represents the range of the frame F in which the person exists. Also, a peak body height extracting unit 14 shown in FIG. 1 is operable to extract the peak body height in the inputted three-dimensional object information, that is, the height of the head top of the person (the body height of the person).

Figure 5:
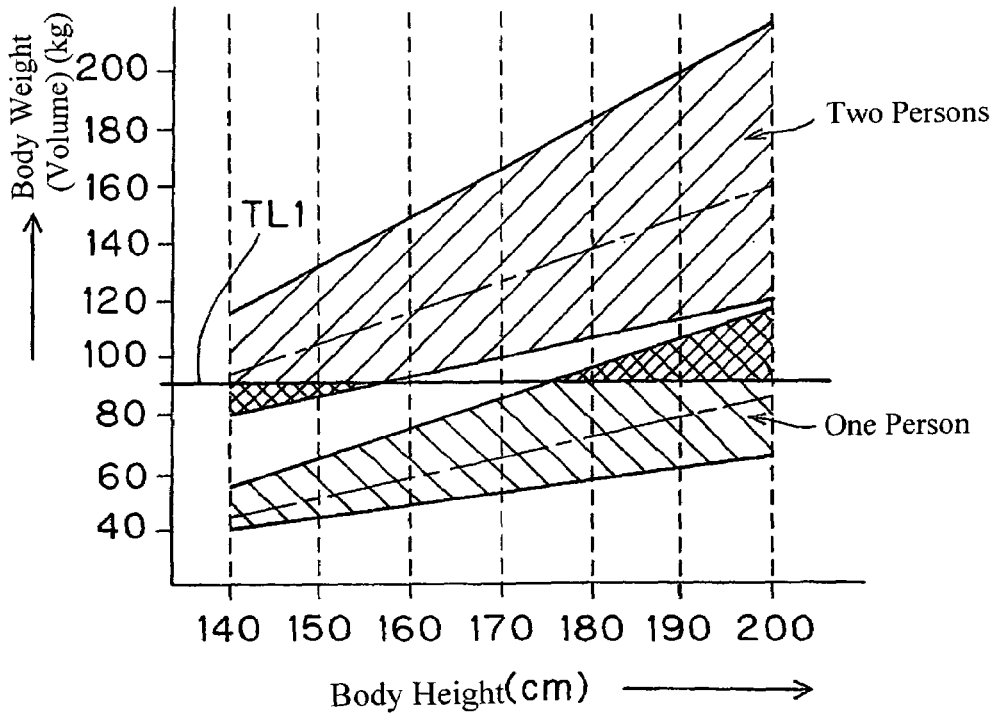
FIG. 5 is a characteristic chart showing the correlation of the volume relative to the height of a threshold value set by the traffic monitoring apparatus.

A threshold value setting memory 18 of the determining device 2A stores therein a threshold value that is used to determine whether the number of persons present in the area under surveillance is one or two, and this threshold value is set in the following manner. FIG. 5 illustrates the range of volumes relative to different body heights of persons, in which the volume is expressed in terms of the body weight for the purpose of facilitating a better understanding.

In FIG. 5, the range shown by a rightwardly downwardly hatched area represents the volume in the case of a single person and the range shown by a rightwardly upwardly hatched area represents the sum of the volumes in the case of two persons. The volume lying at a region intermediate between those ranges is defined as a constant threshold value TL1 regardless of the body height. That is to say, the threshold value TL1 is greater than the average volume of one person having a great body height and smaller than the sum of the average volumes of two persons having a small body height. The threshold value TL1 so defined is stored in the threshold value setting memory 18 referred to above.

A determining unit 17 of the determining device 2A is operable to add together cumulative volumes of the frames F in the volume information inputted from the volume calculating unit 13, to calculate a numerical value proportional to the volume by dividing the added value by the number of the frames F, and finally to multiply the calculated numerical value by a predetermined coefficient to provide the volume, which is one of the object information. In this way, influence which may be brought about by noises contained in the object information can be suppressed.

The determining unit 17 referred to above determines the number of persons in the following manner, based on signals, fed respectively from the volume calculating unit 13 and the peak body height extracting unit 14, and the threshold value TL1 fed from the threshold value setting memory 18. That is to say, where the body height of a person inputted from the peak body height extracting unit 14 is within the range of 155 to 175 cm and the volume from the volume calculating unit 13 is smaller than the volume corresponding to the threshold value TL1 of the volume read out from the threshold value setting memory 18, it is determined that the number of persons is singular, but where the body height is within the range of 155 to 175 cm and the volume of the object information is greater than the volume corresponding to the threshold value TL1, it is determined that the number of persons is two. This result of determination is outputted to the control unit 3, which when the number of persons is determined two, activates the door locking unit 5 to thereby inhibit revolution of the revolving door 4.

As shown by mesh hatched areas in FIG. 5, it may occur that even if the body height is not higher than 155 cm, even two persons will result in the volume that is smaller than TL1 and that even if the body height exceeds 175 cm, even one person will result in the volume that is greater than TL1. In such case, the control unit 3 outputs, for example, an advisory signal to activate a buzzer or lamp (not shown) to thereby invite a security guard to ascertain the number of persons trying to pass across the revolving door 4. It is, however, that where the difference in body height among the passengers is not so large, the peak body height extracting unit 14 may be dispensed with and the number of persons can be determined using only the volume from the volume calculating unit 13, without using any body height.

With the traffic monitoring apparatus according to this embodiment, the number of persons is determined based on at least the volume, which is one of the body height and the body weight of a person contained in the three-dimensional object information and, therefore, since the total volume of two persons generally exceeds the threshold value TL1, it can be assuredly determined that the number of persons trying to pass is plural even in the case where two persons of a small build in close proximity to each other try to pass. On the other hand, in the case of a single person, the volume thereof is generally not greater than the threshold value TL1 and, therefore, there is little possibility of an erroneous determination that the number of persons may be plural.

Figure 6:
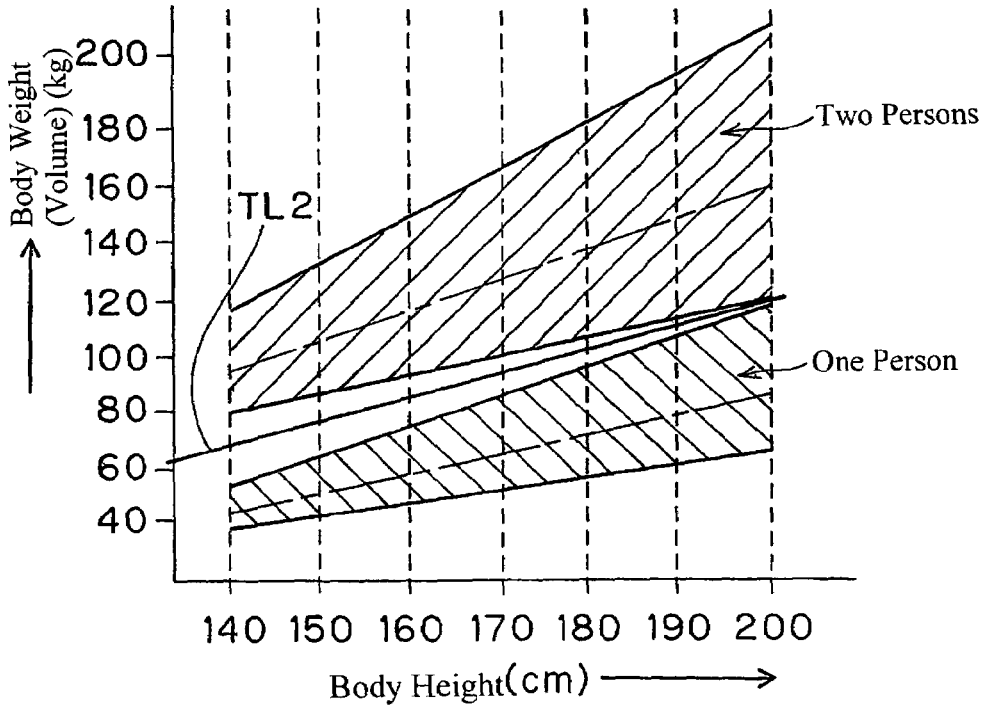
FIG. 6 is a characteristic chart showing the correlation of the volume relative to the height of a different threshold value set by the traffic monitoring apparatus.

Also, although in the foregoing embodiment, the constant volume regardless of the body height is set as the threshold value TL1, instead thereof, the threshold value TL2 based on the volume that varies depending on the body height can be used as shown in FIG. 6. That is to say, this threshold value TL2 is a value that varies from the minimum value, which is larger than the maximum possible volume of one person of short stature and smaller than the sum of minimum possible volumes of two persons of short stature, and to the maximum value, which has successively increased to a higher value with increase of the body height and which is larger than the maximum possible volume of one person of tall stature and smaller than the sum of minimum possible volumes of two persons of tall stature.

Where this variable threshold value TL2 is used, a possible erroneous determination that a single person of an extremely big build may be determined as a plurality of persons and a possible erroneous determination that two persons of an extremely small build trying to pass in proximity to each other may be determined as a single person can be eliminated, with the accuracy of determination of the number of the objects increased consequently.

With respect to a portion of the area 8 under surveillance adjacent the exit EX shown in FIG. 1, effects similar to those described above can be obtained. It is to be noted that the area 8 under surveillance is defined only in the vicinity of the entrance IN, and this equally applies in the following embodiment of the present invention.

Figure 7:
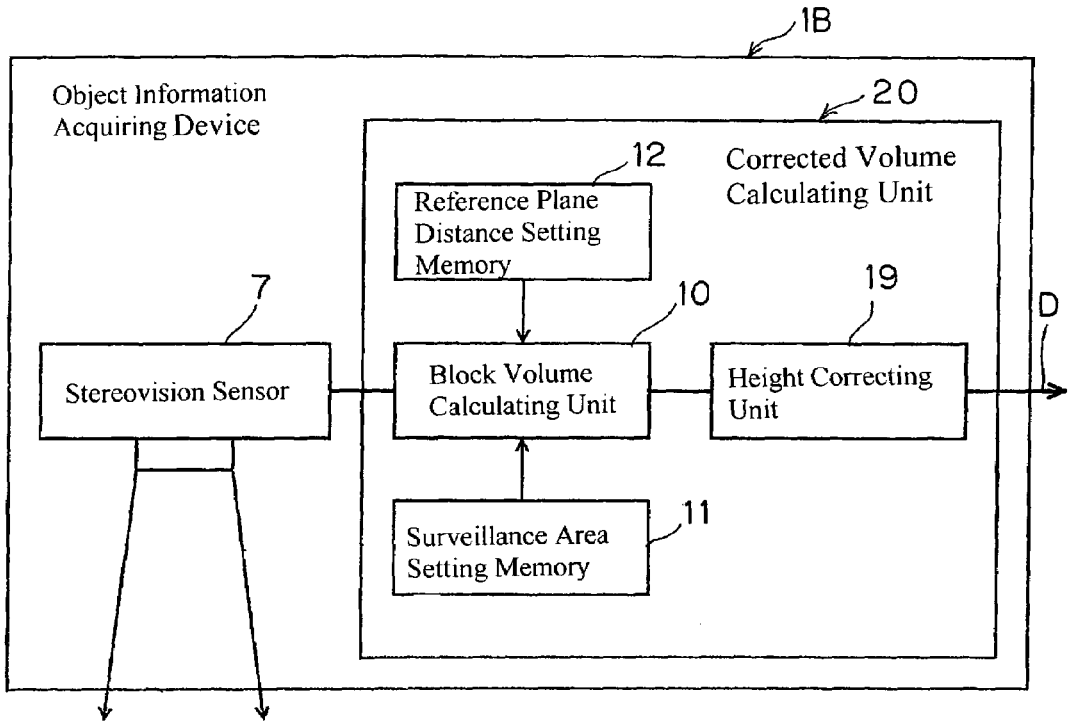
FIG. 7 is a circuit block diagram showing a portion of the traffic monitoring apparatus according to a second preferred embodiment of the present invention.

FIG. 7 illustrates a circuit block diagram showing a portion of the traffic monitoring apparatus according to a second preferred embodiment of the present invention, which differs from the first embodiment in that in place of the object information acquiring device 1A employed in the first embodiment shown in FIG. 1, an object information acquiring device 1B is employed and the threshold value stored in the threshold value setting memory 18 of the determining device 2A is represented by a constant volume as will be described in detail later. With this object information acquiring device 1B, the block volume calculating unit 10, the surveillance area setting memory 11 and the reference plane distance setting memory 12, all employed in the first embodiment, are added with a height correcting unit 19 to provide a corrected volume calculating unit 20.

Figure 8:
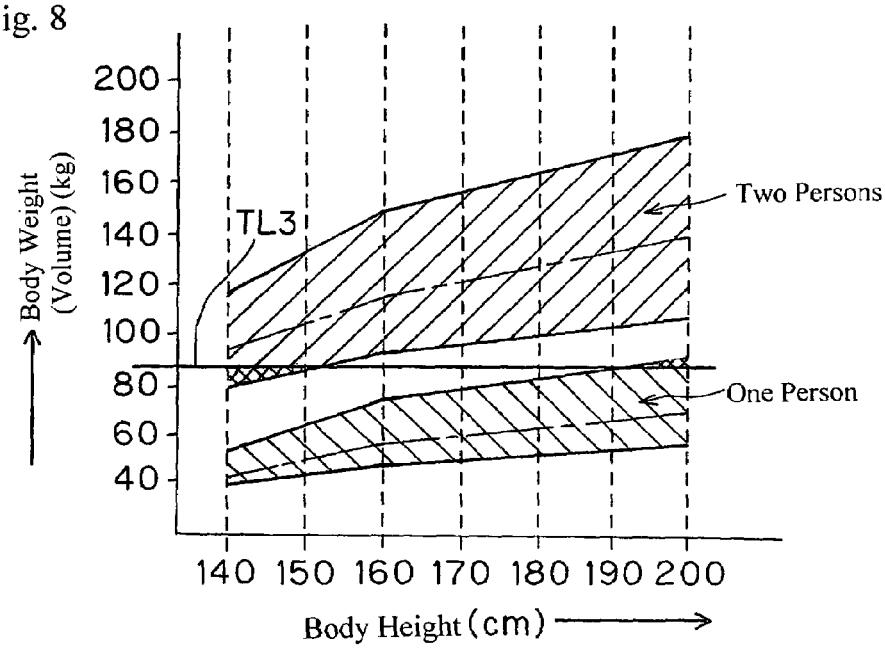
FIG. 8 is a characteristic chart showing the correlation of the volume relative to the height of a different threshold value set by the traffic monitoring apparatus shown in FIG. 7.

As shown in FIG. 8, the height correcting unit 19 is operable to perform a correction in such a way that of the volume information for the respective blocks outputted from the block volume calculating unit 10, a portion of the body height higher than a predetermined body height, for example, 160 cm is replaced with a predetermined body height, that is, 160 cm. Accordingly, since with respect to the body height exceeding 160 cm, it is fixed to the constant body height (which may be slightly increased with increase of the body height), the height correcting unit 19 can output three-dimensional object information D corresponding to the volume for each block excluding a portion of the body height of a person exceeding 160 cm. In view of the this, the threshold value setting memory 18 stores, as a threshold value TL3 as shown in FIG. 8, the constant volume somewhat lower than the threshold value TL1 employed in the first embodiment shown in FIG. 5.

Accordingly, with respect to the person of a body height exceeding 160 cm, since the volume so determined becomes small, the difference in volume resulting from the difference in body height becomes small. In correspondence therewith, by setting a low volume for the constant threshold value TL3, as can readily be understood from comparison between FIG. 5 and FIG. 8, the range in which an erroneous determination would possibly occur as shown by the mesh hatched areas can be minimized as compared with the case in which the threshold value TL1 is employed such as in the first embodiment of the present invention, with the accuracy of determination of the number of persons increased consequently.

Figure 9:
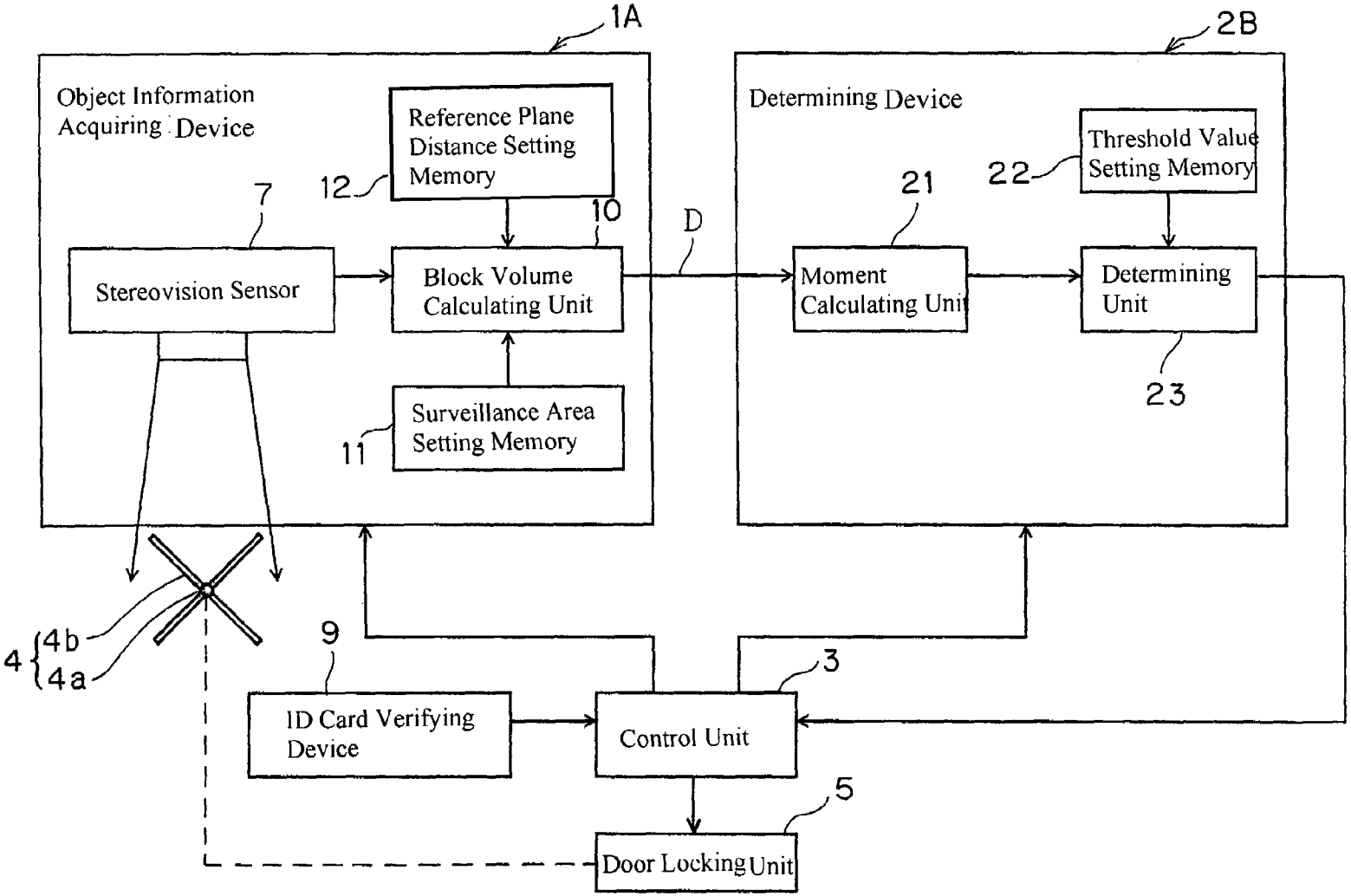
FIG. 9 is a circuit block diagram showing the traffic monitoring apparatus according to a third preferred embodiment of the present invention.

FIG. 9 illustrates a circuit block diagram showing the traffic monitoring apparatus according to a third preferred embodiment of the present invention, which differs from the first embodiment shown in FIG. 1 in respect of the determining device 2B. The determining device 2B is operable to determine the number of objects based on the distribution, on a two-dimensional plane (for example, the floor surface), of volumes of objects from the three-dimensional object information D related with the objects inputted from the object information acquiring device 1A. A moment calculating unit 21 of the determining device 2B is operable to determine a reference point of the distribution based on the distribution, on the two-dimensional plane, of the volumes of the objects contained in the object information D inputted from the object information acquiring device 1A, to determine the moment of the distribution in reference to the distance from the reference point of the distribution to a point of distribution and finally to calculate the moment value corresponding to the moment of distribution that is normalized by the volumes of the objects contained in the object information D.

The detail of the calculating process performed by the moment calculating unit 21 will now be described. Assuming that the coordinates of the floor surface (reference plane) are expressed by x and y and the height z above the floor surface in the coordinates x and y is expressed by z=f(x, y), the product of the surface area s of the floor surface of the block B (FIG. 3) multiplied by the height z, that is, v=sxf(x, y), represents a distribution of volumes on the two-dimensional plane (reference plane). Assuming that s equals to 1, v=f(x, y) represents the distribution of the volumes. The moment calculating unit 21 calculates, based on the height information for each block B (FIG. 3) contained in the object information D inputted from the object information acquiring device 17, the coordinates ($m_x$, $m_y$) on the floor surface having a center of gravity m, using the following equations (1) and (2):

$$m_x = \frac{\int\int_{-\infty}^{\infty} x f(x, y)\, dy \cdot dx}{\int\int_{-\infty}^{\infty} f(x, y)\, dy \cdot dx} \tag{1}$$

$$m_y = \frac{\int\int_{-\infty}^{\infty} y f(x, y)\, dy \cdot dx}{\int\int_{-\infty}^{\infty} f(x, y)\, dy \cdot dx} \tag{2}$$

Figure 10C:
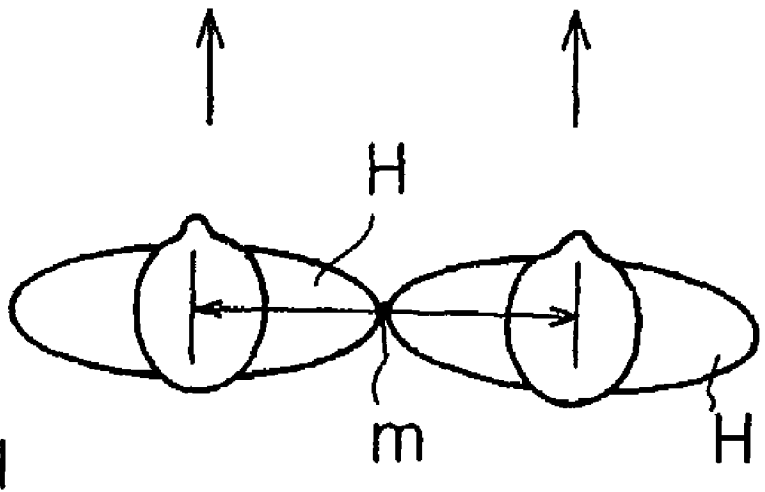
FIGS. 10(*a*) to 10(*c*) are plan views of persons, showing the manner in which a reference point of the distribution of objects is set in the traffic monitoring apparatus shown in FIG. 9, respectively.
Figure 10B:
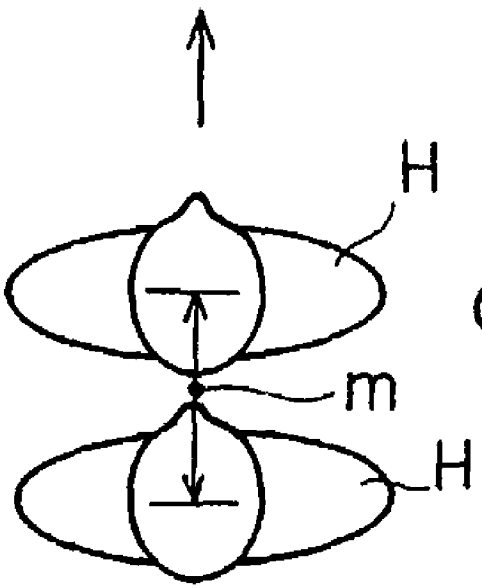
Figure 10A:
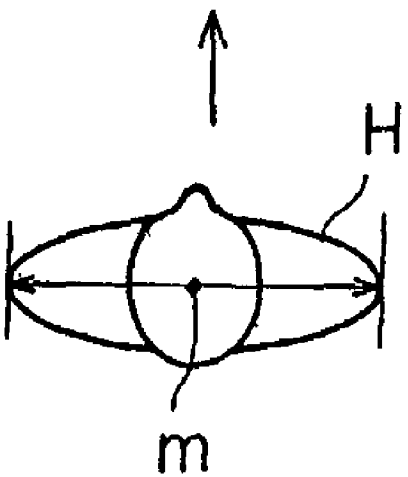

The two-dimensional coordinates ($m_x$, $m_y$) on the floor surface having the center of gravity m that is to be determined will, as shown by FIG. 10A, lie at a center position of the head of a person H in the case where only the person H exists, but at a position intermediate between respective head of persons H in the case where two persons H is lined up or in side-by-side relation with each other as shown by FIG. 10B, and FIG. 10C, respectively.

Then, the moment calculating unit 21 makes use of the coordinates ($m_x$, $m_y$) on the floor surface having the center of gravity m so determined as discussed above to perform the calculating based on the following equation (3) to thereby calculate the n-th order moment value $M_n$. This moment value $M_n$ is the moment of distribution of the volumes, which is determined by the distance ($x-m_x$), ($y-m_y$) from the center of gravity m of the distribution to the point of distribution as shown by the formula (3) and is then normalized by the volume (the denominator of the formula (3)). By this normalization, influence which may be brought about by the difference in body height of the persons H can be excluded. In the case of the absence of any person, the denominator of the formula (3) will be zero and, therefore, no moment value is calculated with the numerator being zero.

$$M_n = \frac{\int\int_{-\infty}^{\infty} [(x-m_x)^2 + (y-m_y)^2]^{n/2} f(x, y)\, dy \cdot dz}{\int\int_{-\infty}^{\infty} f(x, y)\, dy \cdot dx} \tag{3}$$

FIG. 11 illustrates first to sixth order moment values calculated by the moment calculating unit 21 and, as shown by (a) to (c) in FIG. 10, the cases in which a single person H of a big build, two persons in line with each other and two persons in side-by-side relation with each other are trying to pass, respectively, are shown. As can readily be understood from FIG. 11, the moment value $M_n$ in the case of the two persons H present abruptly increases with increase of the order n of the moment, with the difference between the both expanding, as compared with the moment value $M_n$ in the case of one person H. Accordingly, by employing a proper n-th order of moment (for example, fourth order), the moment value intermediate between the moment value $M_n$ in the case of the single person and the moment value $M_n$ in the case of the two persons in line with each other is stored in the threshold value setting memory 22 as a threshold value. A determining unit 23 shown in FIG. 9 is operable to determine the number of persons present being two or more or one, depending on whether the moment value $M_n$ calculated by the moment calculating unit 21 is higher or lower than the threshold value.

With the traffic monitoring apparatus according to the third embodiment, since the number of persons is determined on the distribution of the volumes of the persons H on the two-dimensional plane (floor surface), the number of the persons H can be determined almost without being affected by the influence resulting from the difference in body height and body weight of the persons H. That is to say, since the distribution of the volumes contained in the acquired object information D shows up in an arrangement of a clot in the case where the number of the objects is singular or in an arrangement of separate clots in the case where the number of the objects is plural, even where two persons in side-by-side relation with each other try to pass, it is possible to accurately determine that there are two persons.

Figure 12C:
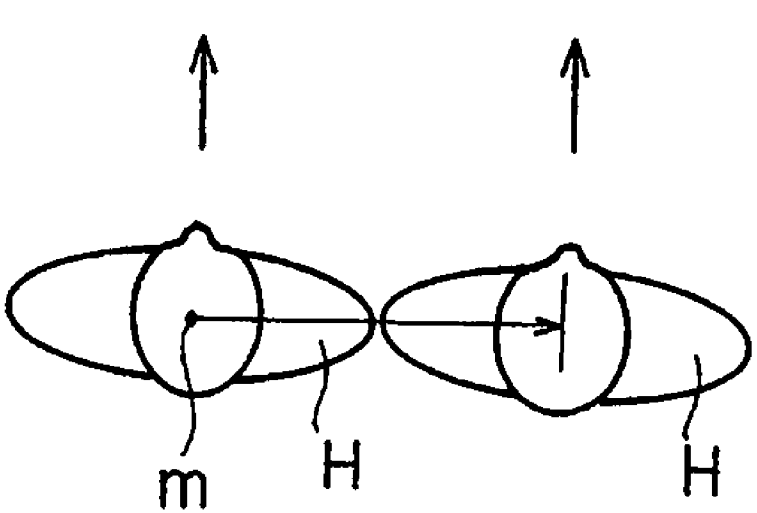
FIGS. 12(*a*) to 12(*c*) are plan view of persons showing the different manner in which a reference point of the distribution of objects is set in the traffic monitoring apparatus shown in FIG. 9, respectively.
Figure 12B:
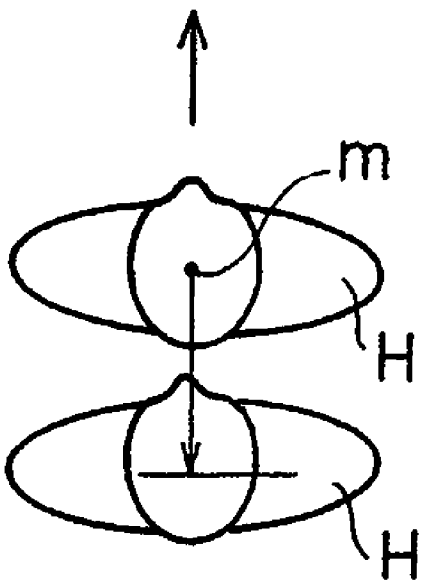
Figure 12A:
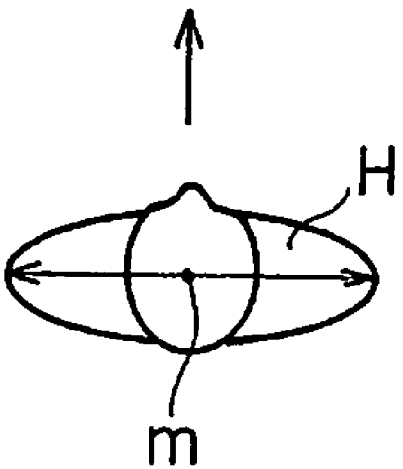

It is to be noted that although in the foregoing embodiment reference has been made to the case in which the center of gravity of the distribution is employed with reference to the reference point of the distribution of volumes of the objects, the vertex at which the height of an object is maximal can be used as a reference point as shown by (a) to (c) in FIG. 12. By way of example, where the number of persons H is singular, the center position of the head shown by (a) in FIG. 12 will be at a position on the two-dimensional plane of the center of gravity m of the distribution of the volumes, but where the number of persons is two, the center position of the head of the person H of a higher body height will be at a position on the two-dimensional plane of the center of gravity m of the distribution of the volumes as shown by (b) and (c) in FIG. 12. The moment calculating unit 21 determines the moment (the numerator of the formula (3)) of the distribution of the volumes based on the distance from the position of the center of gravity m on the two-dimensional plane to the point of distribution, which is normalized by the volume of the object (the denominator of the formula (3)) to provide the moment value $M_n$. Accordingly, there is no need to determine the center of gravity m and, therefore, calculation to determine the moment $M_n$ can advantageously be simplified.

Figure 13:
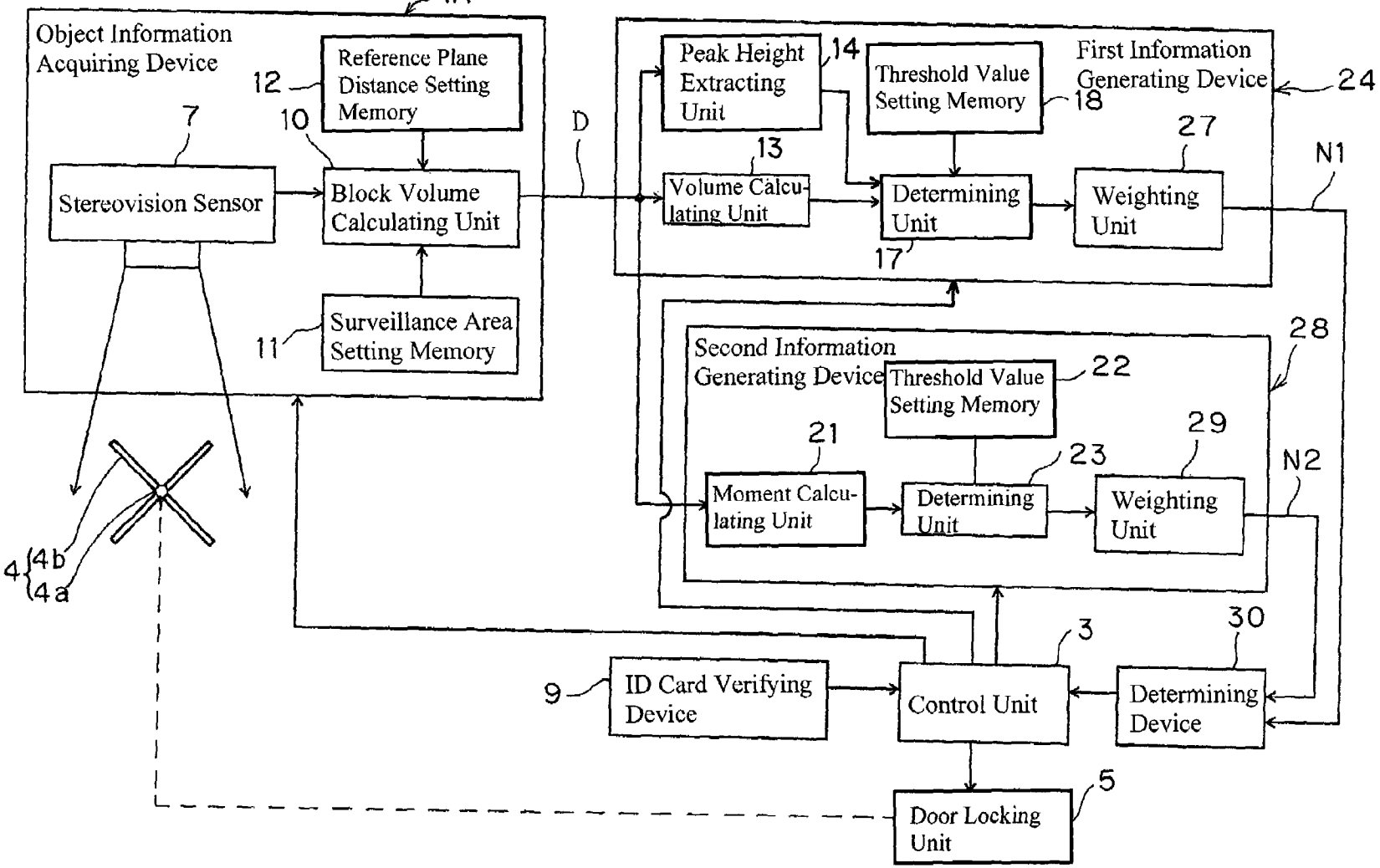
FIG. 13 is a circuit block diagram showing the traffic monitoring apparatus according to a fourth preferred embodiment of the present invention.

FIG. 13 illustrates a circuit block diagram showing the traffic monitoring apparatus according to a fourth preferred embodiment of the present invention. This traffic monitoring apparatus is of a structure similar to a combination of the respective constructions according to the first and second embodiments. That is to say, this traffic monitoring apparatus includes the object information acquiring device 1A employed in any one of the first and third embodiments, a first information generating device 24 of a type in which a weighting unit 27 is added to the structure of the determining device 2A employed in the first embodiment shown in FIG. 1, a second information generating device 28 of a type in which a weighting unit 29 is added to the structure of the determining device 2B employed in the third embodiment shown in FIG. 9, and a determining device 30 for determining the number of objects based on respective information fed from the first and second information generating device 24 and 28.

The first information generating device 24 includes a determining unit 17, which is, as explained in connection with the first embodiment shown in FIG. 1, operable to determine the number of objects based on the height and the volume of the object contained in the object information D, and a weighting unit 27 for multiplying the determined number by a predetermined weighting coefficient to generate a first quantitative information N1 related with the object. The second information generating device 28 includes a determining unit 23 which is, as explained in connection with the third embodiment, operable to determine the number of objects based on the distribution of the volumes of objects from the object information D, and a weighting unit 29 for multiplying the determined number by a predetermined weighting coefficient to generate a second quantitative information N2 related with the object.

By way of example, with the first information generating device 24, when the calculated volume is smaller than the threshold value used to determine whether the number of persons is one or two, the determining unit 17 outputs a determination value "1" indicative of the single person, but when the calculated volume exceeds the threshold value, the determining unit 17 outputs a determination value "2" indicative of the two persons. The weighting unit 27 weights the determination value "2" indicative of the two persons to generate the first quantitative information N1 of a value "2.8". On the other hand, with the second information generating device 28, when the calculated moment value is lower than the threshold value used to determine whether the number of persons is one or two, the determining unit 23 outputs a determination value "1" indicative of the single person, but when the calculated moment value exceeds the threshold value, the determining unit 23 outputs a determination value "2" indicative of the two person. The weighting unit 29 weights the determination value "2" indicative of the two persons to generate the second quantitative information N2 of a value "3.5".

The determining unit 30 adds the weighted first and second quantitative information N1 and N2 together and, when the calculated value attains a value in excess of "6.0", it determines that the number of persons H is two. With this way of weighting, the second quantitative information N2 based on the moment value of a high reliability in quantitative determination is highly counted and, therefore, the determination of the number of the persons can be accomplished with further increased accuracy. Depending on the environment of the area 8 under surveillance, it may occur that the first quantitative information N1 based on the volume may have a higher reliability and, in such case, arrangement should be made so that in order for the first quantitative information N1, rather than the second quantitative information N2, to be highly counted, the weighting unit 27 can weight more value than the weighting unit 29.

With the traffic monitoring apparatus according to this embodiment, since the first quantitative information related with the objects, based on at least the volume, which is one of a volume and a body height of an object, and the second quantitative information related with the objects, based on the distribution of the volumes of those objects are determined from the object information D, the number of the objects are determined based on those two quantitative information. Therefore, demerits of those determining devices can be counterbalanced with each other and, even when the two objects try to pass in any of various postures and/or the object information D contains noises, the number of the objects can be determined with high accuracy.

In any one of the foregoing embodiments of the present invention, determination has been made as to whether the number of persons is one or two or more, it is possible to determine the number of persons exceeding three or more if a threshold value of a quantity (for example, the volume or the moment value) is set between two persons and three persons or between three persons and four persons. Also, the present invention is not always limited to the monitoring of the persons as objects, but can be equally applied to the determination of the number of goods, specifically goods moving past the area under surveillance by means of, for example, a belt conveyor.

The present invention having been fully described hereinbefore, it has now become clear that with the traffic monitoring apparatus of the present invention, the number of the objects are determined based from the three-dimensional object information related with the object present in the area under surveillance, based on at least the volume, which is one of the body height and the volume of the object, or the distribution of volumes of the objects, or the both, and, therefore, regardless of the difference in body height of the objects, the number of the objects can be determined with high precision.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A traffic monitoring apparatus which comprises:

an object information acquiring device for acquiring three-dimensional object information related with an object present in an area under surveillance;

a first information generating device for generating a first quantitative information related with the number of objects based on at least a volume, which is obtained from the object information including volume data and a height of an object;

a second information generating device for generating a second quantitative information related with the number of objects based on a distribution of the volumes of objects in a two-dimensional plane from the object information; and a determining device for determining the number of the objects based on the first and second quantitative information, wherein the object information acquiring device includes a block volume calculating unit for determining, for each of a plurality of blocks into which the area of surveillance is divided, a height of an object in each block and for calculating a volume based on the determined height of the object in each block.

2. The traffic monitoring apparatus as claimed in claim 1, wherein the determining device determines the number of the objects based on a threshold value of the volume.

3. The traffic monitoring apparatus as claimed in claim 1, wherein the determining device determines the number of the objects based on a threshold value of the volume which varies depending on a body height.

4. The traffic monitoring apparatus as claimed in claim 1, wherein the object information acquiring device includes a corrected volume calculating unit for determining the volume of the object except for a portion having a body height exceeding a predetermined value.

5. The traffic monitoring apparatus as claimed in claim 1, wherein the determining device includes a moment calculating unit for determining the moment of the distribution based on the distance in the two-dimensional plane of the distribution from a reference point to a point of distribution and for calculating the value of the moment which is normalized by the volume of the object;

wherein the determining device further comprises a second determining device for determining the number of the objects based on the moment value.

6. The traffic monitoring apparatus as claimed in claim 5, wherein the reference point is a position of the center of gravity of the distribution in the two-dimensional plane.

7. The traffic monitoring apparatus as claimed in claim 5, wherein the reference point is a vertex at which a body height attains a maximum value.

8. The traffic monitoring apparatus as claimed in claim 1, further comprising a weighting unit for weighting at least one of the first and second quantitative information.

* * * * *